US006964633B2

(12) United States Patent
Kolda et al.

(10) Patent No.: US 6,964,633 B2
(45) Date of Patent: Nov. 15, 2005

(54) EXERCISE DEVICE WITH AN ADJUSTABLE MAGNETIC RESISTANCE ARRANGEMENT

(75) Inventors: Clint D. Kolda, Cottage Grove, WI (US); Chang Shin Pin, Taipei (TW)

(73) Assignee: Saris Cycling Group, Inc., Madison, WI (US)

( * ) Notice: Subject to any disclaimer, the term of this patent is extended or adjusted under 35 U.S.C. 154(b) by 0 days.

(21) Appl. No.: 10/369,957

(22) Filed: Feb. 20, 2003

(65) Prior Publication Data

US 2004/0166996 A1 Aug. 26, 2004

(51) Int. Cl.[7] ..... A63B 69/16
(52) U.S. Cl. ..... 482/63
(58) Field of Search ..... 482/51, 57, 60, 482/61, 63

(56) References Cited

U.S. PATENT DOCUMENTS

| | | | |
|---|---|---|---|
| 2,534,133 | A | 12/1950 | Kirkpatrick |
| 3,831,942 | A | 8/1974 | Del Mar |
| 4,678,182 | A | 7/1987 | Nakao et al. |
| 4,752,066 | A | 6/1988 | Housayama |
| 4,775,145 | A | 10/1988 | Tsuyama |
| 4,822,032 | A | 4/1989 | Whitmore et al. |
| 4,826,150 | A | 5/1989 | Minoura |
| 4,898,379 | A | 2/1990 | Shiba |
| 4,982,953 | A | 1/1991 | Makishi |
| 4,986,533 | A | 1/1991 | Lo |
| 5,031,900 | A | 7/1991 | Leask |
| 5,031,901 | A | 7/1991 | Saarinen |

(Continued)

FOREIGN PATENT DOCUMENTS

| | | |
|---|---|---|
| DE | 3603854 | 8/1987 |
| EP | 0215177 | 3/1987 |
| EP | 1040852 | 10/2000 |
| EP | 1132118 | 9/2001 |
| FR | 1180373 | 6/1959 |

OTHER PUBLICATIONS

Communication dated Oct. 18, 2004 including European Search Report.

*Primary Examiner*—Gregory L. Huson
*Assistant Examiner*—Tam Nguyen
(74) *Attorney, Agent, or Firm*—Boyle, Frederickson, Newholm, Stein & Gratz, S.C.

(57) ABSTRACT

A resistance unit for an exercise device, such as a bicycle trainer, includes a magnetic member which cooperates with a rotating electrically conductive member to establish eddy current resistance to rotation of a rotatable member forming a part of the resistance unit. The resistance unit includes a body to which the rotatable member is mounted, and an adjustment mechanism is interconnected with the magnetic member and the body for adjusting the position of the magnetic member relative to the electrically conductive member, to adjust the eddy current resistance experienced by the rotatable member. The magnetic member is movably mounted within a passage defined by the body, and the adjustment mechanism includes a manually operable actuator which is accessible from the exterior of the body. The actuator is rotatable relative to the body, and rotation of the actuator functions to move the magnetic member toward and away from the electrically conductive member, to adjust the eddy current resistance. The rotatable member is interconnected with a flywheel, and the electrically conductive member is mounted to and rotatable with the flywheel to apply resistance to rotation of the rotatable member through the flywheel.

26 Claims, 8 Drawing Sheets

U.S. PATENT DOCUMENTS 5,051,638 A 9/1991 Pyles
5,072,930 A 12/1991 Sun
5,094,447 A 3/1992 Wang
5,096,024 A 3/1992 Wu
5,145,480 A 9/1992 Wang
5,178,594 A 1/1993 Wu
5,180,348 A 1/1993 Saarinen
5,195,618 A 3/1993 Wu
5,247,854 A 9/1993 Wu
5,254,061 A 10/1993 Leask
RE34,479 E 12/1993 Minoura
5,310,392 A 5/1994 Lo
5,324,242 A 6/1994 Lo
5,382,208 A 1/1995 Hu
5,397,285 A 3/1995 Haan et al.
5,437,353 A 8/1995 Wu
5,468,201 A 11/1995 Minoura
5,472,392 A 12/1995 Haan et al.
5,522,781 A 6/1996 Minoura
5,569,128 A 10/1996 Dalebout
5,586,624 A 12/1996 Ko et al.
5,628,711 A 5/1997 Boucher
5,656,001 A * 8/1997 Baatz ..... 482/61
5,685,806 A 11/1997 Yu
5,704,876 A 1/1998 Baatz
5,711,404 A 1/1998 Lee
5,728,029 A 3/1998 Minoura
5,830,112 A 11/1998 Wang et al.
5,848,953 A 12/1998 Wei et al.
5,851,165 A 12/1998 Wei et al.
5,879,273 A 3/1999 Wei et al.
5,944,638 A 8/1999 Maresh et al.
6,042,517 A 3/2000 Gunther et al.
6,042,518 A 3/2000 Hildebrandt et al.
6,071,215 A 6/2000 Raffo et al.
6,084,325 A 7/2000 Hsu
6,095,953 A 8/2000 Lee et al.
6,146,313 A 11/2000 Whan-Tong et al.
6,162,152 A 12/2000 Kuo
6,234,938 B1 5/2001 Chen
6,244,990 B1 6/2001 Cheng
6,273,845 B1 8/2001 Liou
6,736,761 B2 * 5/2004 Huang ..... 482/57
2001/0003110 A1 6/2001 Lay

* cited by examiner

EXERCISE DEVICE WITH AN ADJUSTABLE MAGNETIC RESISTANCE ARRANGEMENT

BACKGROUND AND SUMMARY OF THE INVENTION

This invention relates to an exercise device, and more particularly to a magnetic resistance arrangement for an exercise device.

An exercise device, such as a stationary bicycle trainer, incorporates a resistance unit for applying resistance during operation of the device. The resistance unit typically includes a rotatable member, such as a shaft or roller, that rotates in response to work performed by the user. Resistance to rotation of the shaft or roller is accomplished several different ways, including wind resistance, fluid resistance, and resistance established by one or more magnetic members that interact with an electrically conductive member which rotates along with the shaft or roller, to establish eddy current resistance to rotation of the shaft or roller. Examples of magnetic resistance mechanisms are shown and described in Wei. et. al. U.S. Pat. No. 5,879,273 as well as copending U.S. patent application Ser. No. 10/054,781 filed Jan. 23, 2002, the disclosures of which are hereby incorporated by reference. The '781 patent application discloses a magnetic resistance arrangement in which one or more magnets are located adjacent a rotating electrically conductive member. The magnets are moved outwardly under the influence of centrifugal forces resulting from rotation of the rotatable member to which the magnets are mounted. Such outward movement of the magnets increases the distance of the magnets from the axis of rotation of the rotatable shaft or roller, to increase the resistance to rotation of the shaft or roller in proportion to increased speed of operation. The '273 patent discloses a system in which one or more magnets are mounted to a plate. The plate is interconnected with an adjustment mechanism by which the spacing between the magnets and the rotatable electrically conductive member can be adjusted, to vary the eddy current force that applies resistance during operation of the device.

It is an object of the present invention to provide an adjustable magnetic resistance arrangement for a resistance unit for use in an exercise device such as a bicycle trainer. It is a further object of the invention to provide such an adjustable magnetic resistance arrangement in which the resistance is adjusted by the user independent of the speed of operation of the device. It is a further object of the invention to provide such an adjustable magnetic resistance arrangement which involves a relatively small number of parts, to facilitate assembly and to provide a relatively low cost of manufacture. Yet another object of the invention is to provide such an adjustable magnetic resistance arrangement in which resistance is adjusted by varying the space between a magnetic member and a rotatable electrically conductive member interconnected with a rotatable shaft or roller forming a part of the exercise device.

In accordance with the present invention, a resistance unit, such as for use in an exercise device, includes a body or housing and a rotatable member, such as a shaft or roller, that is rotatably mounted to the body or housing. In one application, the exercise device may be in the form of a stationary bicycle trainer in which the driven wheel of a bicycle is engaged with the shaft or roller, to impart rotation to the shaft or roller.

An electrically conductive member, such as a plate, is interconnected with the rotatable member. In one embodiment, the rotatable member is interconnected with a flywheel that rotates along with the rotatable member, and the electrically conductive member is secured to the flywheel so as to rotate along with the rotatable member and the flywheel. A magnetic member is mounted to the housing, and interacts with the electrically conductive member to establish eddy current resistance to rotation of the electrically conductive member, which is transferred to the rotatable member through the flywheel.

An adjustment mechanism is interposed between the magnetic member and the body or housing, for adjusting the space between the magnetic member and the electrically conductive member to vary the strength of the eddy current resistance. In one embodiment, the magnetic member is received within a passage formed in the body or housing, and the adjustment mechanism is operable to vary the position of the magnetic member within the passage so as to move the magnetic member toward and away from the electrically conductive member. The body or housing may define a pair of oppositely facing surfaces between which the passage is located. The electrically conductive member is located adjacent one of the oppositely facing surfaces, and the adjustment mechanism includes an actuator that is located adjacent the other of the oppositely facing surfaces. The actuator is preferably rotatable, and the adjustment mechanism is configured so as to vary the position of the magnetic member in response to rotation of the actuator.

A vane arrangement may be interposed between the electrically conductive member and the flywheel, for providing air movement upon rotation of the rotatable member and the flywheel, to cool bearings that provide rotatable mounting of the rotatable member to the body or housing.

The invention contemplates a resistance unit as summarized above, as well as an improvement in a resistance unit and a method of adjusting the resistance of a resistance unit, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
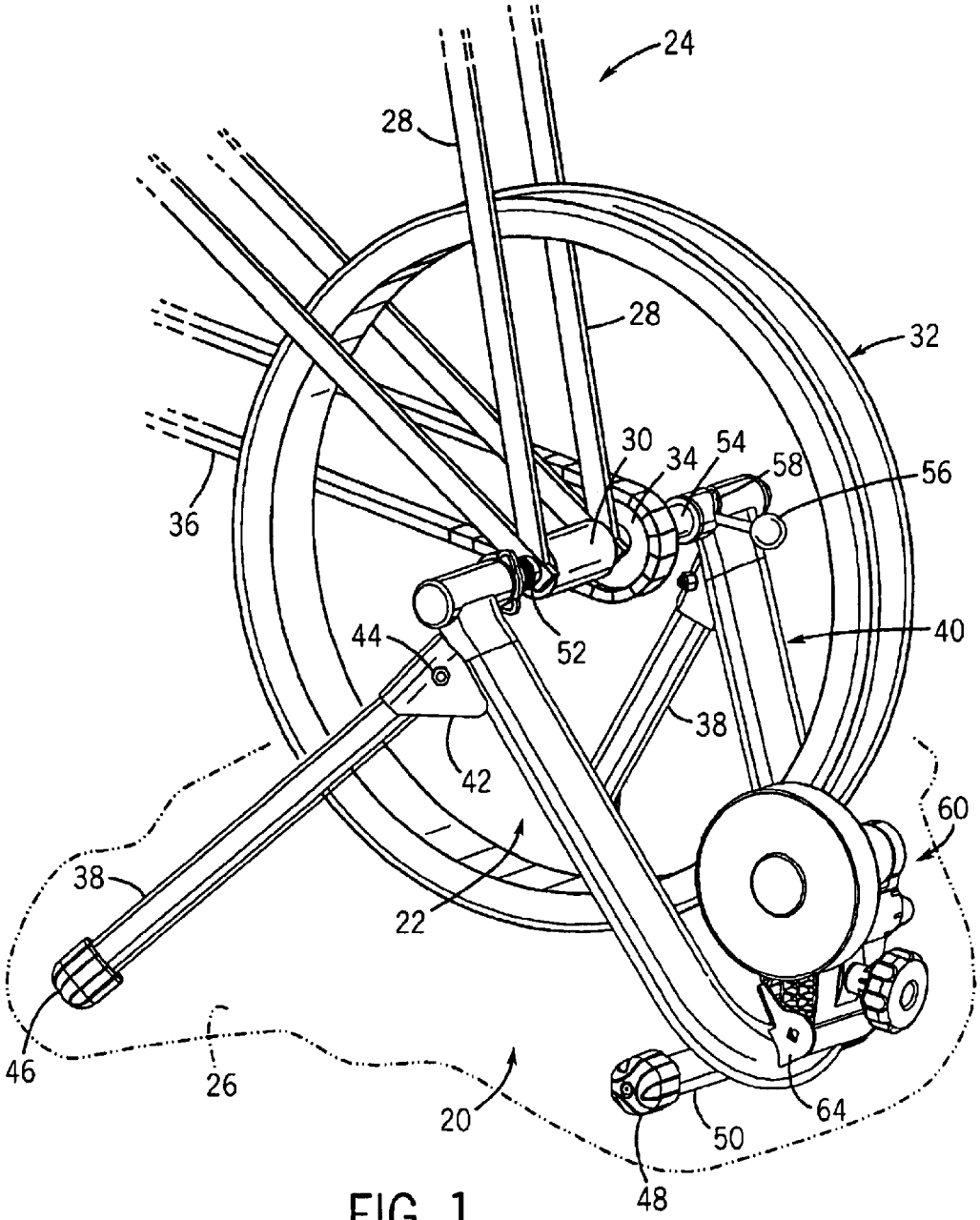
FIG. 1 is an isometric view illustrating an exercise device, in the form of a bicycle trainer, which utilizes a resistance unit incorporating the adjustable magnetic resistance arrangement of the present invention.
Figure 2:
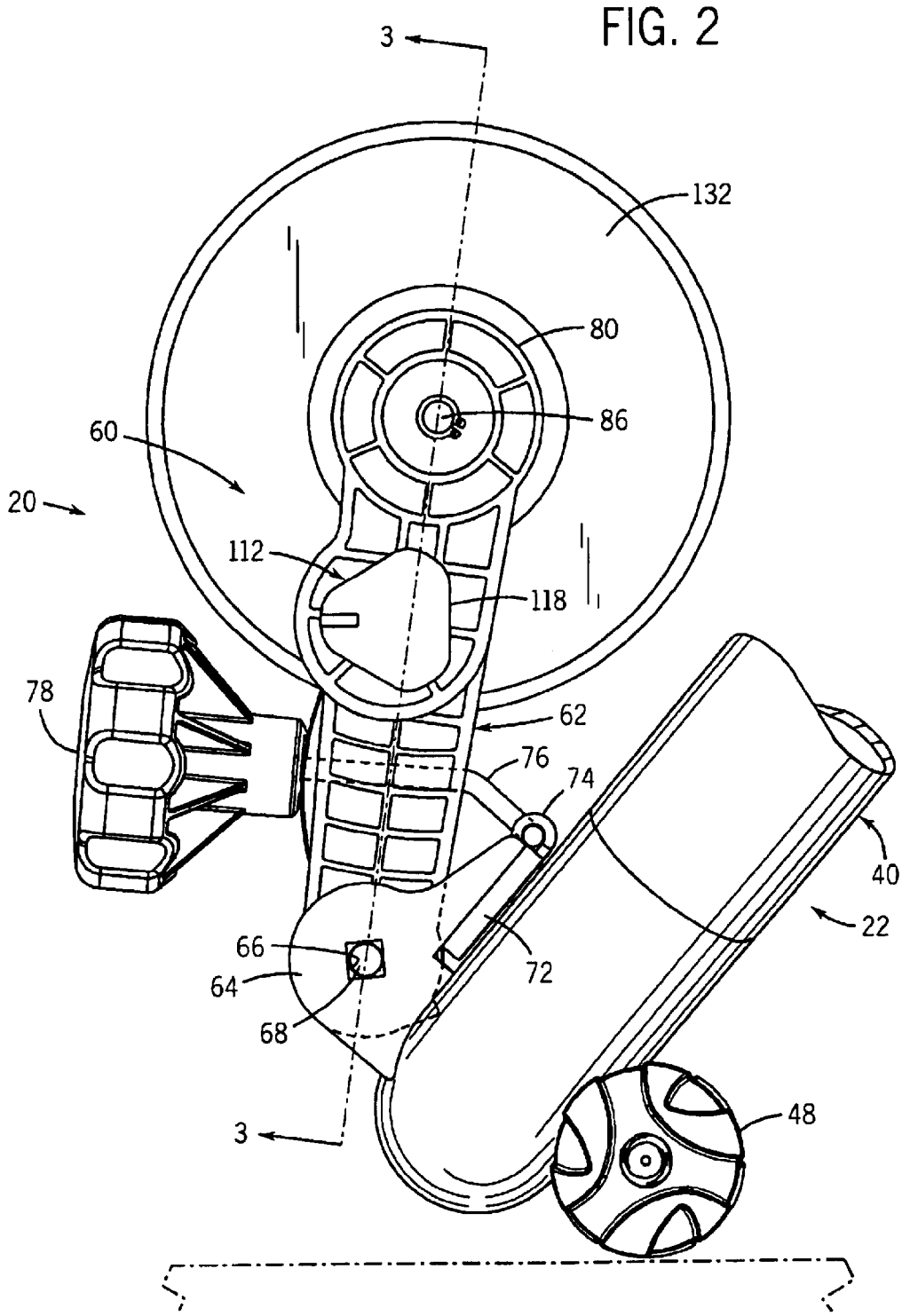
FIG. 2 is a partial side elevation view of the lower end of the exercise device of FIG. 1.
Figure 3:
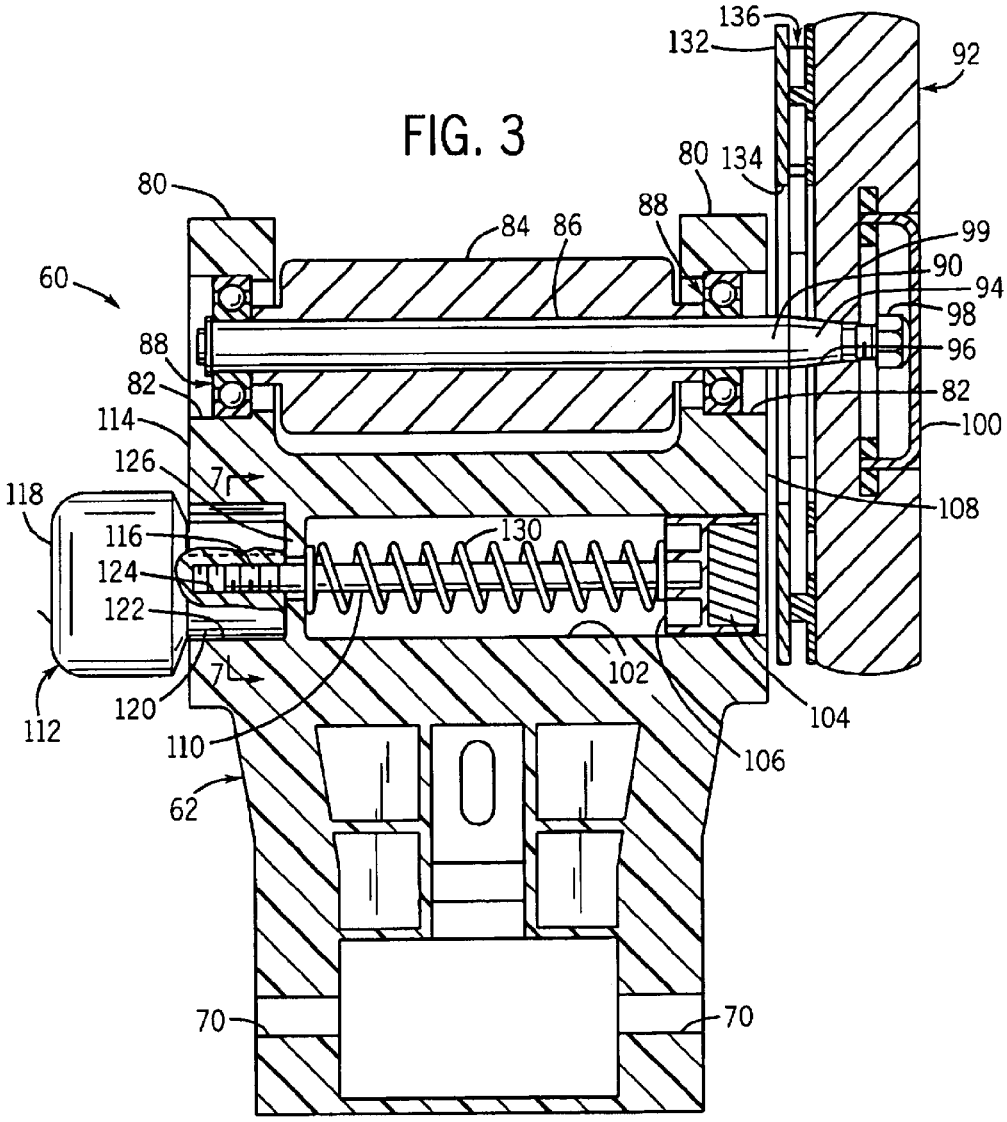
FIG. 3 is a section view taken along line 3—3 of FIG. 2.

Referring to FIGS. 1 and 2, a bicycle training device 20 generally includes a frame 22 that is adapted to releasably support a bicycle 24. Frame 22 rests on a horizontal surface 26 such as a floor. Frame 22 is of conventional construction, and may be that such as is incorporated into trainers manufactured by the Cycle-Ops Division of Graber Products, Inc. of Madison, Wis. Bicycle 24 includes downwardly extending frame members or stays 28 that support the hub 30 of a wheel 32 associated with bicycle 24. Hub 30 carries a sprocket 34 driven by a chain 36 in response to a conventional pedal and crank assembly associated with bicycle 24, in a manner as is known.

Frame 22 has a pair of generally forwardly extending legs 38 attached to opposite ends of a generally U-shaped support member 40. Legs 38 also preferably extend outwardly with respect to support member 40, to provide stability for bicycle training device 20. Legs 38 and support member 40 are formed of a generally rigid material, such as metal tubing, and may have a circular cross section. Each of legs 38 is connected to support member 40 by a brace 42 that is secured to support member 40. A bolt 44 extends through the leg 38 and brace 42, and a nut is engaged with the threads of bolt 44 such that leg 38 is pivotable about bolt 44 between an extended position as shown, and a folded position for storage. Opposite the brace 42, each leg 38 also includes a foot 46 formed of a resilient high friction material, such as rubber, that serves to prevent the leg 38 from slipping with respect to the surface 26 on which the frame 22 is positioned. The support member 40 also includes a pair of feet 48 attached to opposite ends of a horizontal cross member 50 secured to the lower end of support member 40 opposite legs 38. Cross member 50 provides stability to the rear of bicycle training device 20, and assists legs 38 in holding bicycle training device 20 stable and stationary on the support surface 26.

Bicycle training device 20 includes a releasable engagement mechanism located at the upper end of support member 40, which includes a stationary engagement section 52 mounted to one of the legs of support member 40, and a movable engagement member 54 interconnected with a manually operated lever 56, which is mounted to the other leg of support member 40. In a known manner, one end of the axle of hub 30 is engaged with stationary engagement member 52, and lever 56 is operated so as to move within an angled cam slot 58 formed in a cylinder within which engagement member 54 is received, so as to bring movable engagement member 54 into engagement with the opposite end of the axle of hub 30. In this manner, the rear of bicycle 24 is engaged with and supported by frame 22, such that the rear wheel 32 of bicycle 24 is located above the support surface 26 and can thus be rotated by operation of the pedals of bicycle 24.

A resistance unit 60 is movably mounted to frame 22 adjacent cross member 50. Resistance unit 60 includes a housing or body 62 that is pivotably attached to support member 40 between a pair of mounting members 64, in a known manner. Each mounting member 64 is fixed to support member 40, and functions to hold resistance unit 60 on support member 40. Each mounting member 64 includes an opening 66, and a pivot shaft 68 extends through the aligned openings 66 and through aligned passages 70 defined by body 62, for pivotably mounting the lower end of body 62 to and between mounting members 64. A plate 72 extends between and interconnects mounting members 64, and defines a sleeve 74, at its upper end. One end of an adjustment rod 76 is engaged within sleeve 74, and the opposite end of adjustment rod 76 is threaded and engaged with a knob 78 which bears against body 62. In a known manner, knob 78 and adjustment rod 76 are used to move resistance unit 60 into engagement with bicycle wheel 32.

Resistance unit 60 includes a pair of outer ears 80, which define aligned passages 82. A roller 84 is located between ears 80, and is carried by a shaft 86 that extends through an axial passage defined by roller 84. A bearing 88 is pressed into each passage 82 and engaged with a step defined by the passage 82, and shaft 86 extends through and is engaged with bearings 88 for providing rotation of shaft 86 and roller 84 relative to body 62.

Shaft 86 includes an extension 90 that extends outwardly of one of bearings 88, and a flywheel 92 that is secured to shaft extension 90. Shaft extension 90 includes a tapered section 94, which is received within a tapered passage 96 formed in flywheel 92. The end of shaft extension 90 is threaded, and a nut 98 is engaged with the threaded end of shaft extension 90 for retaining flywheel 92 on shaft extension 90. Nut 98 is received within a recess 99 defined by flywheel 92, and a cover 100 is received within flywheel recess 99 for enclosing nut 98 and providing a continuous outer surface of flywheel 92.

A magnetic resistance arrangement functions to provide resistance to rotation of flywheel 92, which is transferred through shaft 90 and roller 84 to resist rotation of bicycle wheel 32, to thereby provide resistance to a user during exercise using bicycle 24. The resistance arrangement is of the magnetic type, wherein a magnet and a rotating electrically conductive member function to establish eddy current resistance upon operation of bicycle training device 20.

In accordance with the present invention, a passage 102 is formed in body 62, and a magnet 104 is received within passage 102. In the illustrated embodiment, magnet 104 is mounted to a magnet carrier 106, which has a cross section corresponding to that of passage 102 such that magnet carrier 106 is slidably received in passage 102. Passage 102 opens onto a side surface 108 defined by body 62, such that the face of magnet 104 is exposed to the exterior of body 62.

An adjustment mechanism is interposed between body 62 and magnet carrier 106, for varying the position of magnet 104 within passage 102. The adjustment mechanism includes a shaft 110 that is engaged at one end with magnet carrier 106, and engaged at its opposite end with an actuator 112 which is located outwardly of a side surface 114 defined by body 62. Side surface 114 faces in a direction opposite that of side surface 108. The end of shaft 110 opposite magnet carrier 106 includes threads 116. Actuator 112 includes an external head portion 118 and a collar portion 120 that is received within a recess 122 extending inwardly from side surface 114 of body 62. Collar portion 120 includes an internally threaded passage 124, and threads 116 at the end of shaft 10 are engaged with threaded passage 124. A wall 126 is located between the inner end of passage 102 and the inner end of recess 122. The end of actuator collar portion 120, shown at 128 (FIG. 5) bears against the surface of wall 126 that faces outwardly in the direction of side surface 114. Within passage 102, a spring 130 bears between the surface of wall 126 that faces in the same direction as side surface 108, and the facing end of magnet carrier 106. Spring 130 functions to bias magnet carrier 106 outwardly, to maintain end 128 of collar portion 120 in engagement with the outwardly facing surface of wall 126.

Resistance unit 60 further includes an electrically conductive member, in the form of a conductive plate 132, which is interconnected with flywheel 92. Conductive plate 132 defines a central opening 134 through which shaft extension 90 extends. Conductive plate 132 is oriented so as to be in alignment with the end of passage 102 that opens onto side surface 108 of body 62. A vane member 136 is mounted to flywheel 92, and conductive plate 132 is secured to vane member 136. Conductive plate 132 may be formed of any satisfactory metallic or non-metallic material that is electrically conductive, such as aluminum or copper.

In operation, rotation of bicycle wheel 32 is transferred to roller 84, which in turn imparts rotation to shaft 86 and flywheel 92, and conductive plate 132 and vane member 136 rotate along with flywheel 92. In a manner as is known, magnet 104 and conductive plate 132 interact to establish eddy current resistance to rotation of conductive plate 132 upon rotation of conductive plate 132. Such resistance to rotation of conductive plate 132 also resists rotation of flywheel 92, shaft 86 and roller 84, to thereby resist rotation of bicycle wheel 32.

Figure 4:
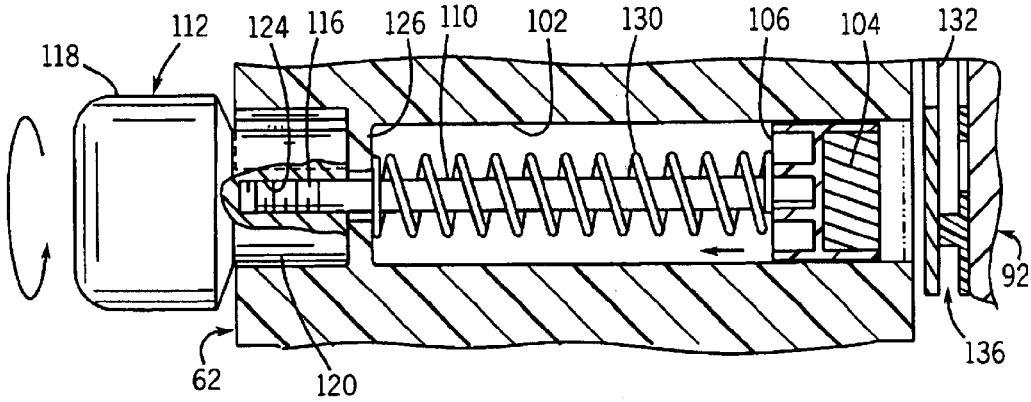
FIG. 4 is an enlarged partial section view of a portion of the resistance unit as shown in FIG. 3, illustrating an adjustment mechanism for moving the magnetic member of the resistance unit toward and away from the electrically conductive member.

The degree of resistance provided by magnet 104 and conductive plate 132 (i.e. the eddy current resistance established upon rotation of conductive plate 132 relative to magnet 104) is adjusted by varying the position of magnet 104 within passage 102, to vary the spacing between magnet 104 and conductive plate 132. To accomplish this, head portion 118 of actuator 112 is rotated, which functions to cause axial movement of shaft 110 within passage 102, to move magnet 104 inwardly or outwardly within passage 102 toward and away from conductive plate 132. Spring 130 functions to apply a constant outward bias on magnet carrier 106, to maintain end 128 of actuator collar portion 120 in engagement with the outwardly facing surface of wall 126. Magnet carrier 106 and passage 102 are preferably formed with a mating non-circular cross section, which resists rotation of shaft 110 when actuator head portion 118 is rotated, to cause such axial movement of shaft 110 due to the treaded engagement between shaft threaded end 116 and threaded passage 124 of actuator collar portion 120. Alternatively, the area of shaft 110 that extends through wall 126 may have a non-circular cross section, and the passage in wall 126 through which shaft 110 extends may be provided with a mating non-circular cross section, to prevent rotation of shaft 110 when actuator head 118 is rotated. FIG. 4 illustrates movement of magnet carrier 106 within passage 102 upon rotation of actuator head 118.

Figure 5:
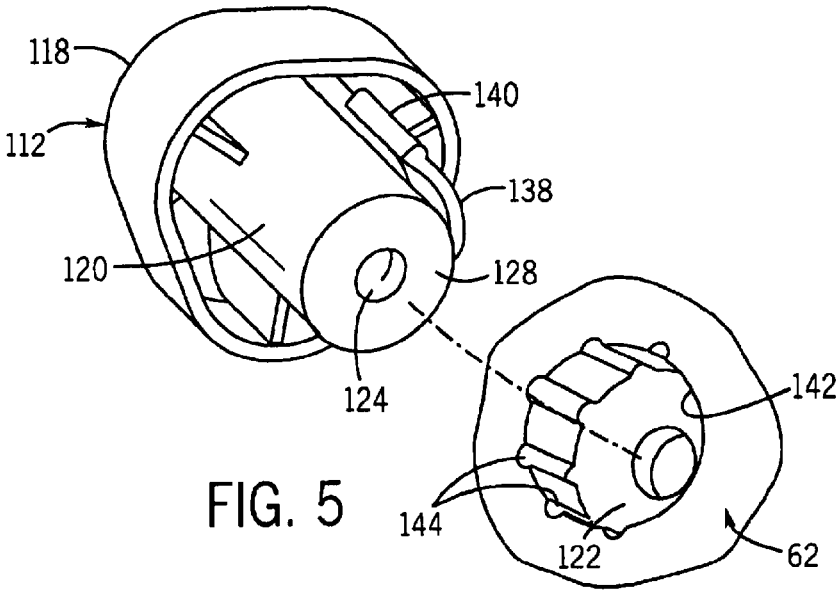
FIG. 5 is a partial exploded isometric view illustrating an actuator associated with the adjustment mechanism illustrated in FIG. 4.
Figure 6:
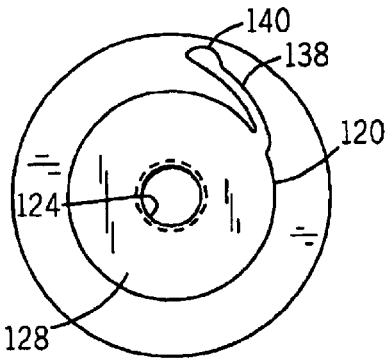
FIG. 6 is an end view of the adjustment mechanism actuator illustrated in FIG. 5.
Figure 7:
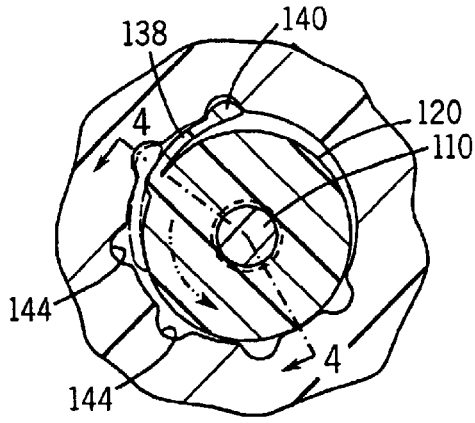
FIG. 7 is a partial section view taken along line 7—7 of FIG. 3.

As shown in FIGS. 5–7, collar portion 120 of actuator 112 includes a wing 138 having an outwardly extending rib 140 at its outer end. Wing 138 is engaged with collar portion 120 at its inner end, and is formed such that the material of wing 138 provides an outward bias of wing 138.

Recess 122 in body 62 includes a side wall 142 having spaced apart grooves 144. Each groove 144 is configured to receive rib 140. As shown in FIG. 7, rib 140 is engaged within one of grooves 144 to prevent rotation of actuator 112. When it is desired to turn actuator head 118 to adjust the position of magnet 104, the rotational force applied to actuator head 118 causes inward movement of wing 138 by engagement of rib 140 with the edge of groove 144. Rib 140 dislodges from groove 144, and rib 140 rides on the area of recess side wall 142 between the adjacent grooves 144. Upon continued rotation of actuator head 118, the outward bias of wing 138 functions to move rib 140 into the adjacent groove 144, which provides a tactile and audible indication that actuator 112 is rotated to a predetermined position relative to body 62. Grooves 144 are positioned such that engagement of rib 140 within each groove 144 corresponds to a certain predetermined level of resistance as dictated by the axial position of magnet 104 relative to conductive plate 132 when actuator head 118 is rotated to engage rib 140 within the groove. The user can rotate actuator head 118 to adjust the position of magnet 104 to provide the desired amount of resistance. In a preferred form, visual marks are provided on body 62 and actuator head 118 to indicate the rotational position of actuator head 118 relative to body 62, to provide the user with a visual indication of the resistance level according to the space between magnet 104 and conductive plate 132, as dictated by the position of magnet 104 within passage 102.

FIGS. 9–12 illustrate an alternative adjustment mechanism for varying the position of magnet 104 relative to conductive plate 132, and like reference characters will be used where possible to facilitate clarity. In this embodiment, the end of shaft 110 opposite magnet carrier 106 is engaged with a sleeve 150 that extends from actuator collar portion 120', which is received within recess 122' that extends inwardly from side surface 114' of body 62. Passage 102' and collar portion 120' are configured so as to have matching circular cross sections, to enable magnet carrier 106' to be rotated within passage 102'. Spring 130 bears against wall 126' and the facing surface of magnet carrier 106', to urge magnet carrier 106' and magnet 104' outwardly toward conductive plate 132.

Actuator collar portion 120' defines a recess 152 in its end that faces wall 126', and a pair of wedge-shaped locating members 154 extend outwardly from sleeve 150 through recess 152. Collar portion 120' defines a pair of arcuate side walls 156 that extend between locating members 154, which terminate in end edges 158.

Figure 10:
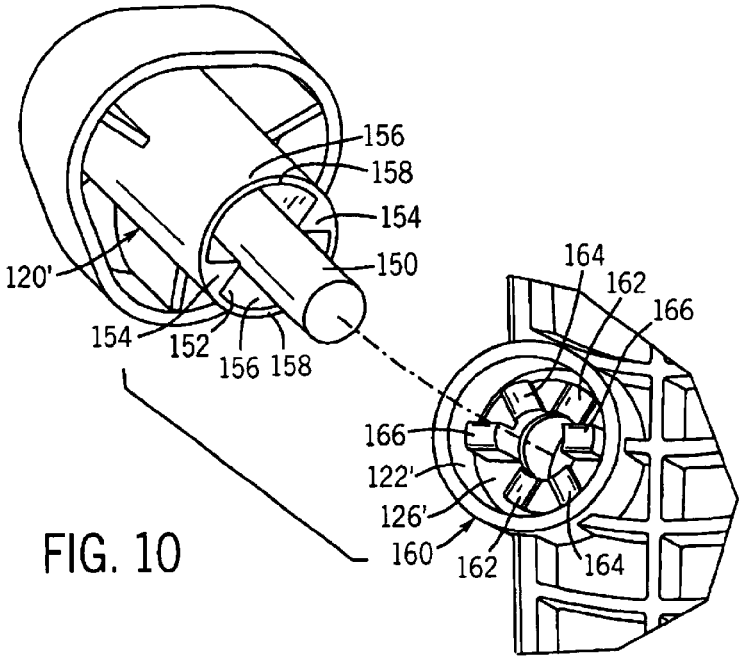
FIG. 10 is a view similar to FIG. 5, showing an actuator incorporated in the adjustment mechanism of FIGS. 8 and 9.

As shown in FIG. 10, recess 122' is defined by a circular hub 160. A series of pairs of aligned protrusions 162, 164 and 166 extend from wall 126' into recess 122'. Protrusions 162, 164 and 166 have a progressively increasing height relative to wall 126'. A space is defined between the inside surface of the side wall of hub 160 and the radial outer end of each of protrusions 162, 164 and 166, which is sized so as to receive side walls 156' of actuator collar portion 120'.

Figure 8:
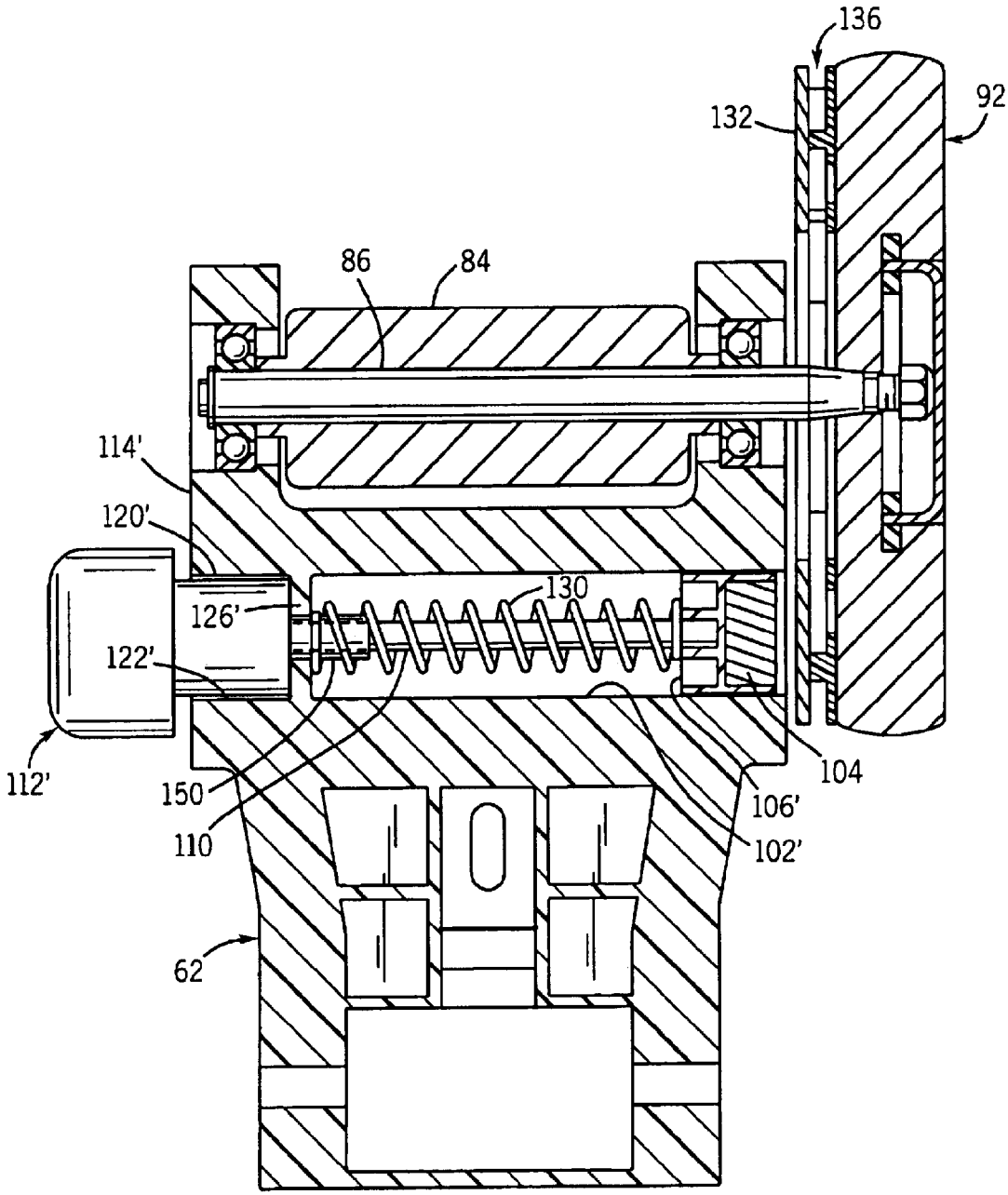
FIG. 8 is a view similar to FIG. 3, showing an alternative embodiment of an adjustment mechanism for varying the position of the magnetic member relative to the electrically conductive member.
Figure 9:
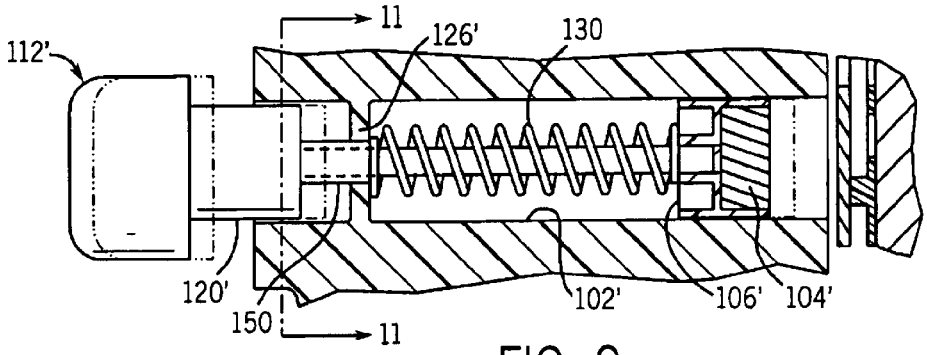
FIG. 9 is an enlarged partial section view of a portion of the resistance unit illustrated in FIG. 8, showing operation of the adjustment mechanism for varying the position of the magnetic member.
Figure 11:
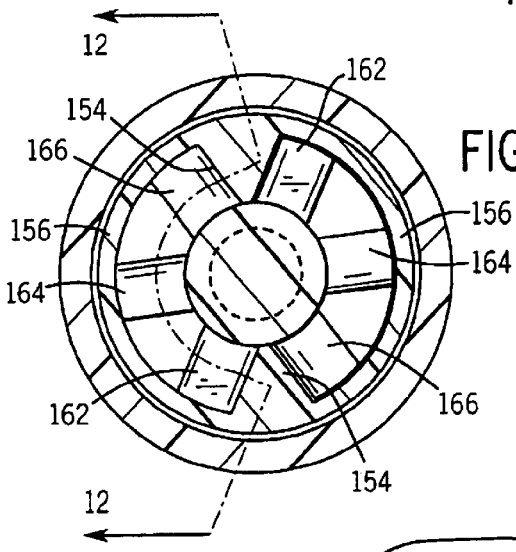
FIG. 11 is a partial section view taken along line 11—11 of FIG. 9.
Figure 12:
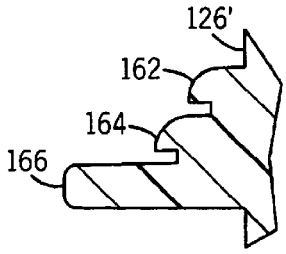
FIG. 12 is a partial section view taken along line 12—12 of FIG. 11.

In operation, the adjustment mechanism of FIGS. 9–12 functions as follows to provide adjustment in the space between magnetic member 104 and conductive plate 132. Locating members 154, which are spaced 180° apart from each other, are engageable with one of the sets of protrusions 162, 164 and 166, or may be received between the adjacent protrusions. To provide an innermost position of magnetic member 104, as shown in FIG. 8, locating members 154 are received within any one of the wedge-shaped spaces between the adjacent protrusions 162, 164 and 166. To provide a first decrease in the level of resistance, the user applies an axial outward force to actuator head 118, to move magnet carrier 106' outwardly away from conductive member 132 within passage 102', against the force of spring 130. The user then rotates actuator 112' so as to engage locating members 154 with protrusions 164. To provide a further decrease in resistance, the same steps are undertaken to engage locating members 154 with protrusions 164. The same set of steps is repeated to provide a still further decrease in resistance, by engaging locating members 154 with protrusions 166. To return the level of resistance to the maximum level, locating members 154 are positioned between any of the adjacent protrusions, which allows spring 130 to move actuator 112' inwardly to a position in which edges 158 of side walls 156 engage the outwardly facing surface of wall 126', as shown in FIG. 8.

Figure 13:
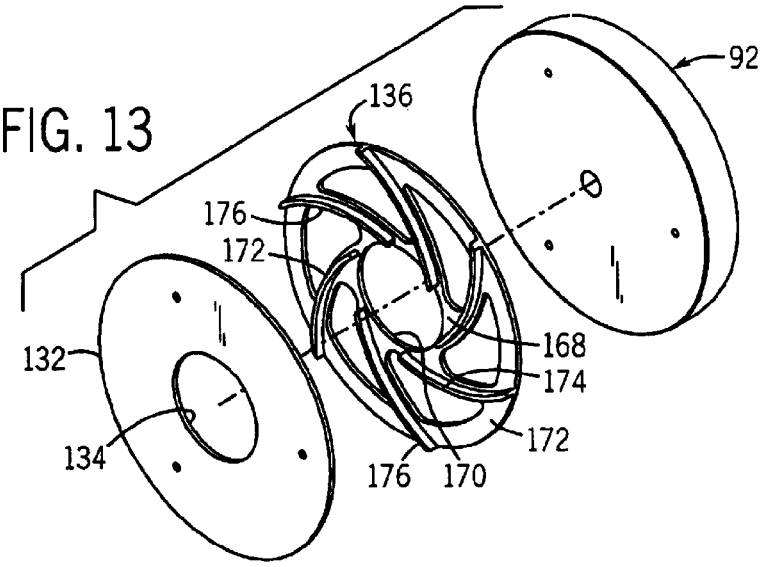
FIG. 13 is an exploded isometric view illustrating a flywheel and an electrically conductive member incorporated in the resistance unit of FIGS. 1–3, in combination with a vane member for providing air movement upon operation of the resistance unit.

FIG. 13 illustrates flywheel 92, conductive plate 132 and vane member 136, which is sandwiched between flywheel 92 and conductive member 132. Vane member 136 includes a central section 168 within which an opening 170 is formed. Opening 170 is located in alignment with opening 134 in conductive member 132. Vane member 136 further includes an outer section 172, and a series of spokes 174 extend between inner section 168 and outer section 172. Spokes 174 extend outwardly and are curved in a forward direction, and each spoke 174 includes a laterally extending vane 176 that extends from a plane defined by central section 168 and outer section 172.

In operation, vane member 136 functions to draw air inwardly upon rotation of flywheel 92, due to the orientation of vanes 176. The air is "scooped" by each of vanes 176 upon rotation, and is directed inwardly toward opening 170. This functions to move air against the inner surface of flywheel 92 within the spaces between spokes 174 and in the area exposed through opening 170. The air impinges on shaft extension 99, as well as the adjacent areas of body 62, and provides overall air flow in the vicinity of flywheel 92 during operation of resistance unit 60. This functions to provide an overall cooling effect on resistance unit 60.

Figure 14:
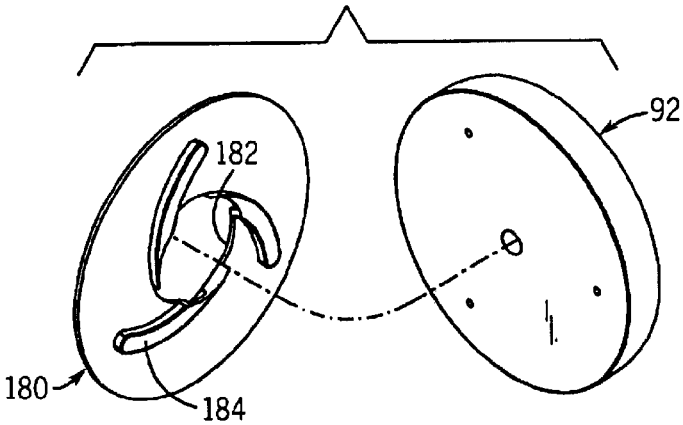
FIG. 14 is a view similar to FIG. 13, showing an alternative embodiment of a vane arrangement.
Figure 15:
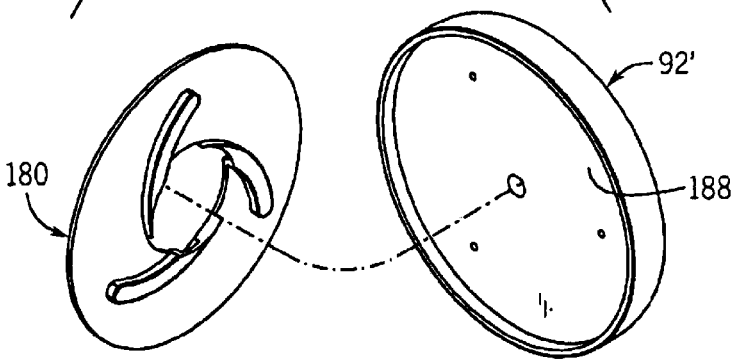
FIG. 15 is a view similar to FIGS. 13 and 14, showing a further alternative embodiment of the vane arrangement.
Figure 16:
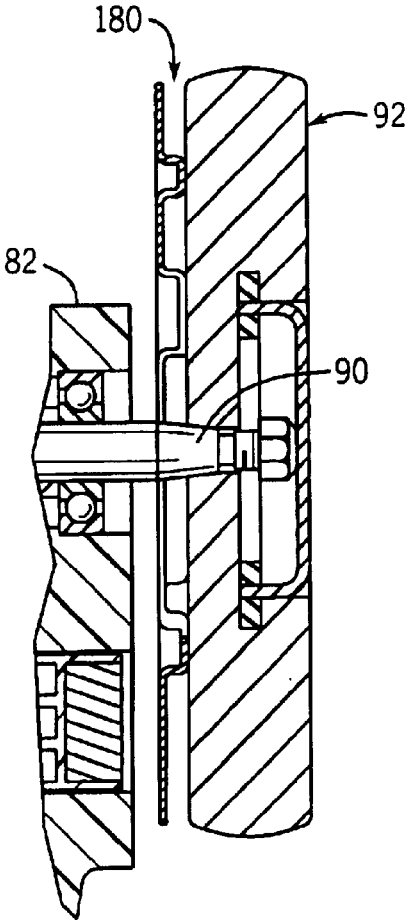
FIG. 16 is a partial section view showing the assembled flywheel, electrically conductive member and vane member of FIG. 14.
Figure 17:
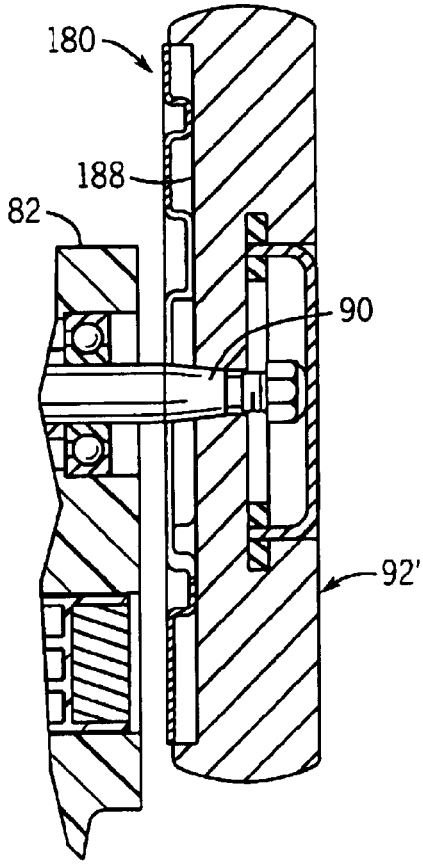
FIG. 17 is a view similar to FIG. 16, showing the assembled flywheel, electrically conductive member and vane member of FIG. 15.

FIG. 14 illustrates an alternative arrangement, in which conductive member 132 is eliminated and replaced with a vane member 180 that is formed of a conductive material. This arrangement combines the cooling function and eddy current generating function into a single member, to reduce part count and increase efficiency. In this embodiment, vane member 180 is generally in the form of a disc having a central opening 182 and a series of curved vanes 184 that project laterally from the plane of vane member 180. Vanes 184 again function as scoops during rotation of flywheel 92, to move air inwardly toward opening 182 and to provide overall air turbulence upon rotation of flywheel 92, to provide a cooling effect. FIG. 15 illustrates conductive vane member 180 as in FIG. 14, which is received within a shallow recess 188 defined by flywheel 92'. Again, vanes 184 function to draw air inwardly upon rotation of flywheel 92', and to provide air flow in the vicinity of flywheel 92' to provide a cooling effect.

While the invention has been shown and described with respect to certain embodiments, it is understood that various alternatives and modifications are possible and are contemplated as being within the scope of the present invention. For example, and without limitation, the present invention has been described with respect to movement of magnet 104 within passage 102 toward and away from conductive member 132, to vary the strength of the eddy current resistance to rotation of roller 84. It is also contemplated that magnet 104 may be stationarily mounted to body 62 in a fixed position, and that the position of conductive plate 132 on shaft 86 may be adjusted relative to the stationary magnet, to vary the strength of the eddy current resistance. It is also understood that a single magnet such as 104 may be employed as shown and described, or that resistance unit 60 may include any number of magnets. Further, it is understood that the illustrated adjustment mechanisms are representative of any number of mechanisms that may be employed to vary the position of magnet 104 within passage 102. While the illustrated adjustment mechanisms involve manual adjustment of the position of the magnetic member, it is also understood that the position of the magnet within the passage of the body may also be accomplished via a cable and actuator, or by an electrically operated adjustment mechanism. It is also understood that adjustment of the position of magnet 104 may be accomplished with a spring that biases in an opposite direction than spring 130, or that the spring may be eliminated entirely. In addition, it is also understood that the vane members, such as 136, 180, may be eliminated and that conductive plate 132 may be mounted directly to flywheel 92. While this arrangement does not provide the cooling effect that is accomplished when a vane member is used, it nonetheless provides a satisfactorily eddy current resistance mechanism for resisting rotation of shaft 86. It is also contemplated that flywheel 92 may be eliminated or may be located in a different location other than adjacent conductive member 132, e.g. interconnected with the opposite end of shaft 86. The presence of the rotating conductive member 132 adjacent magnet 104 functions to establish the eddy current resistance with or without flywheel 92.

In addition, it is understood that the rotating vane member, which provides a cooling function upon operation of the device, may be used in any type of resistance unit and is not limited to use in connection with a magnetic unit as shown and described. For example, a rotating vane member such as that shown in the drawings may be used in a fluid-type resistance unit or in an electronic resistance unit. In addition, while the rotating vane member is shown as being mounted to the flywheel, it is understood that the vane member may be mounted in any location for rotation with the shaft.

Various alternatives and embodiments are contemplated as being within the scope of the following claims particularly pointing out and distinctly claiming the subject matter regarded as the invention.

We claim:

1. A resistance unit, comprising:

a body;

a rotatable member mounted to the body for rotation relative to the body, wherein the rotatable member is located exteriorly of the body and is rotatable relative to the body about an axis of rotation;

an electrically conductive member interconnected with the rotatable member for rotation with the rotatable member;

a magnetic member located within a passage defined by the body and spaced from the rotatable member, wherein the magnetic member interacts with the electrically conductive member to establish eddy current resistance to rotation of the rotatable member upon rotation of the rotatable member; and an adjustment mechanism interposed between the body and the magnetic member, wherein the adjustment mechanism is configured and arranged to move the magnetic member toward and away from the rotatable member in a direction parallel to the axis of rotation of the rotatable member to vary the eddy current resistance to rotation of the rotatable member.

2. The resistance unit of claim 1, wherein the electrically conductive member is located adjacent a surface defined by the body.

3. The resistance unit of claim 2, wherein the passage defined by the body opens onto the surface of the body.

4. The resistance unit of claim 2, wherein the body defines a first surface adjacent the rotatable member and a second surface facing in a direction opposite the first surface, and wherein the adjustment mechanism includes a manually engageable actuator member located exteriorly of the second surface of the body, and wherein the magnetic member is interconnected with the actuator member such that operation of the actuator member functions to adjust the space between the magnetic member and the electrically conductive member.

5. The resistance unit of claim 4, wherein the adjustment mechanism includes a biasing member interposed between the magnetic member and the body for biasing the magnetic member toward the electrically conductive member.

6. The resistance unit of claim 5, wherein the magnetic member is interconnected with a shaft, and wherein the shaft and the actuator member are threadedly interconnected with each other and wherein the actuator member and the body define facing surfaces in engagement with each other, wherein the threaded interconnection between the shaft and the actuator member is operable to adjust the position of the magnetic member upon rotation of the actuator member.

7. The resistance unit of claim 5, wherein the actuator member defines an engagement area and wherein the body defines a plurality of engagement surfaces, wherein the engagement surfaces are oriented such that engagement of the actuator member engagement area with different ones of the engagement surfaces is operable to vary the spacing between the magnetic member and the electrically conductive member.

8. The resistance unit of claim 1, wherein the electrically conductive member includes vane structure for providing an air moving function upon rotation of the electrically conductive member.

9. A resistance unit, comprising:

a body;

a rotatable member mounted to the body for rotation relative to the body;

an electrically conductive member interconnected with the rotatable member for rotation with the rotatable member, wherein the electrically conductive member includes vane structure for providing an air moving function upon rotation of the electrically conductive member;

a magnetic member carried by the body and spaced from the rotatable member, wherein the magnetic member interacts with the electrically conductive member to establish eddy current resistance to rotation of the rotatable member upon rotation of the rotatable member;

an adjustment mechanism interposed between the body and the magnetic member for varying the space between the magnetic member and the rotatable member to vary the eddy current resistance to rotation of the rotatable member; and a flywheel interconnected with the rotatable member, wherein the electrically conductive member and the flywheel are located adjacent each other.

10. The resistance unit of claim 9, wherein the electrically conductive member comprises a conductive plate interconnected with the rotatable member and spaced from the flywheel, and wherein the vane structure is located between the conductive plate and the flywheel.

11. In a resistance unit for an exercise device including a body and a rotatable member, wherein the rotatable member is mounted to the body for rotation about an axis of rotation, the improvement comprising an electrically conductive member located exteriorly of the body and interconnected with the rotatable member, a magnetic member carried by the body and spaced from the electrically conductive member, and an adjustment mechanism interposed between the body and the magnetic member, wherein the body defines a pair of oppositely facing external surfaces between which the magnetic member is located, wherein the electrically conductive member is located adjacent a first one of the oppositely facing surfaces and wherein the adjustment mechanism includes an actuator located adjacent a second one of the oppositely facing surfaces, wherein the adjustment mechanism is operable to move the magnetic member toward and away from the electrically conductive member in a direction parallel to the axis of rotation, to vary the space between the magnetic member and the rotatable member, and wherein the magnetic member and the electrically conductive member interact to establish eddy current resistance to rotation of the rotatable member upon rotation of the electrically conductive member, and wherein variation in the space between the magnetic member and the electrically conductive member by operation of the adjustment mechanism is operable to vary the eddy current resistance.

12. The improvement of claim 11, wherein the magnetic member is disposed within a passage defined by the body.

13. The improvement of claim 12, wherein the passage opens onto the first one of the oppositely facing surfaces.

14. The improvement of claims 11, wherein the actuator is rotatable relative to the body, and wherein the adjustment mechanism is configured to interact with the body so as to provide movement of the magnetic member toward and away from the electrically conductive member upon rotation of the actuator relative to the body.

15. In a resistance unit for an exercise device including a body and a rotatable member, the improvement comprising an electrically conductive member interconnected with the rotatable member, a magnetic member carried by the body and spaced from the electrically conductive member, and an adjustment mechanism interposed between the body and the magnetic member, wherein the adjustment mechanism is operable to vary the space between the magnetic member and the rotatable member; and wherein the magnetic member and the electrically conductive member interact to establish eddy current resistance to rotation of the rotatable member upon rotation of the electrically conductive member; and wherein variation in the space between the magnetic member and the electrically conductive member by operation of the adjustment mechanism is operable to vary the eddy current resistance; and wherein the electrically conductive member comprises a conductive plate secured to the rotatable member, and further comprising a flywheel interconnected with the rotatable member and located adjacent the conductive plate.

16. The improvement of claim 15, wherein the electrically conductive plate includes vane structure for providing air movement about the body upon rotation of the conductive plate and the rotatable member.

17. A resistance unit for an exercise device, comprising:

a body;

a rotatable member carried by the body, wherein the rotatable member is rotatable relative to the body about an axis of rotation;

an electrically conductive member interconnected with the rotatable member so as to be rotatable with the rotatable member, wherein the electrically conductive member is located exteriorly of the body; and magnetic means for interacting with the electrically conductive member to establish eddy current resistance to rotation of the rotatable member through the electrically conductive member, wherein the magnetic means is located within a passage defined by the body and is movable toward and away from the electrically conductive member in a direction parallel to the axis of rotation to vary the eddy current resistance to rotation of the rotatable member through the electrically conductive member.

18. The resistance unit of claim 17, wherein the magnetic means comprises a magnetic member mounted to the body, and adjustment means interconnected with body and with the magnetic member for selectively moving the magnetic member toward and away from the electrically conductive member in a direction parallel to the axis of rotation to vary the eddy current resistance to rotation of the electrically conductive member.

19. The resistance unit of claim 18, wherein the adjustment means comprises actuator means rotatably mounted to the body, and position adjustment means interposed between the actuator means and the magnetic member for adjusting the position of the magnetic member relative to the electrically conductive member in response to rotation of the actuator means.

20. The resistance unit of claim 19, wherein the electrically conductive member is located outwardly of a first surface defined by the body and wherein the actuator means is located outwardly of a second surface defined by the body that faces in a direction away from the first surface, and wherein the actuator means includes an elongated connector member that extends through the passage and is interconnected with the magnetic member.

21. The resistance unit of claim 2, wherein the passage extends along a longitudinal axis oriented parallel to the axis of rotation of the rotatable member.

22. The resistance unit of claim 8, further comprising a flywheel interconnected with the rotatable member, wherein the electrically conductive member and the flywheel are located adjacent each other.

23. The resistance unit of claim 22, wherein the electrically conductive member comprises a conductive plate interconnected with the rotatable member and spaced from the flywheel, and wherein the vane structure is located between the conductive plate and the flywheel.

24. The improvement of claim 12, wherein the passage extends along a longitudinal axis oriented parallel to the axis of rotation of the rotatable member.

25. The improvement of claim 11, wherein the electrically conductive member comprises a conductive plate secured to the rotatable member, and further comprising a flywheel interconnected with the rotatable member and located adjacent the conductive plate.

26. The improvement of claim 25, wherein the electrically conductive plate includes vane structure for providing air movement about the body upon rotation of the conductive plate and the rotatable member.

* * * * *